US005857578A

United States Patent [19]

Fishman

[11] Patent Number: 5,857,578

[45] Date of Patent: Jan. 12, 1999

[54] SLATWALL DISPLAY SYSTEM AND METHOD THEREFOR

[76] Inventor: Eli Fishman, 2140 W. Fulton St., Chicago, Ill. 60612-2314

[21] Appl. No.: 853,791

[22] Filed: May 9, 1997

[51] Int. Cl.[6] ..... A47F 5/00

[52] U.S. Cl. ..... 211/189

[58] Field of Search ..... 211/94.01, 87.01, 211/189

[56] References Cited

U.S. PATENT DOCUMENTS 1,852,715 4/1932 Greenbaum .
4,497,858 2/1985 Dupont et al. .
4,572,381 2/1986 Breakey et al. .
4,805,783 2/1989 Mayer ..... 211/94.01
5,398,468 3/1995 Erickson ..... 211/94.01
5,655,674 8/1997 Holztrager ..... 211/94.01

*Primary Examiner*—Alvin Chin-Shue
*Assistant Examiner*—Sarah L. Purol
*Attorney, Agent, or Firm*—Trexler, Bushnell, Giangiorgi & Blackstone, Ltd.

[57] ABSTRACT

The present invention is directed to a modular display system and method. The modular display system and apparatus is preferably comprised of one or more interlocking panels, and complimentary interlocking side and corner trim members so that modular displays of different shapes and sizes can be constructed.

22 Claims, 2 Drawing Sheets

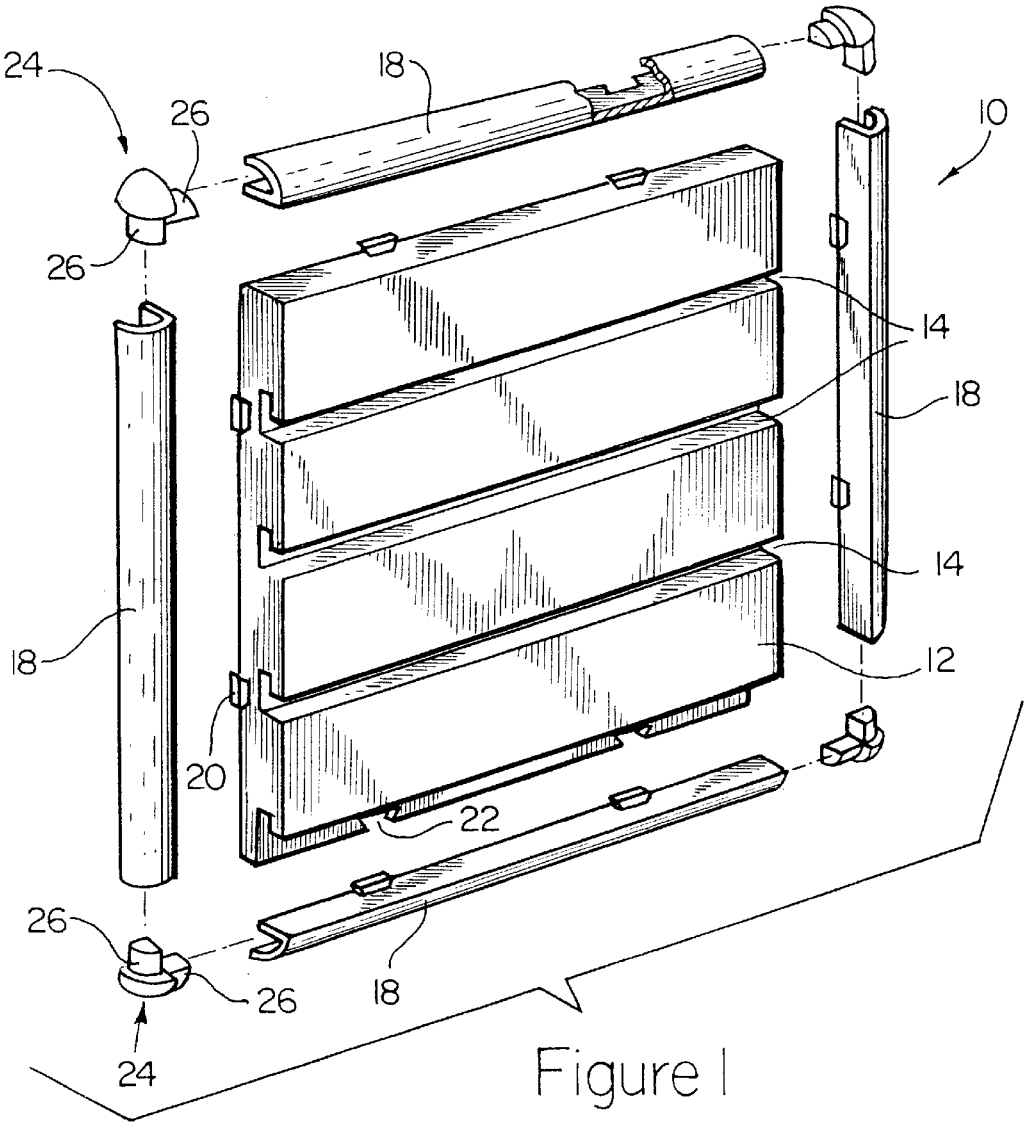
Figure 1
Figure 2A
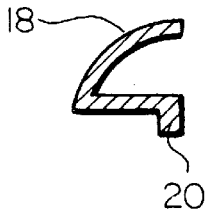
Figure 2
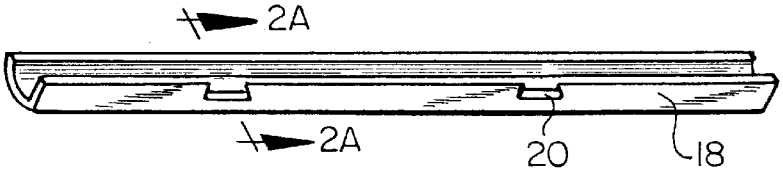
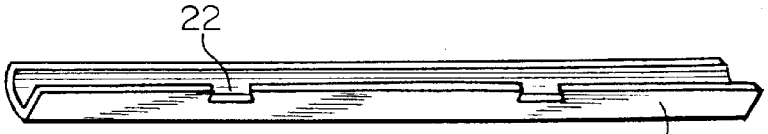
Figure 3

SLATWALL DISPLAY SYSTEM AND METHOD THEREFOR

BACKGROUND OF THE INVENTION

FIELD OF INVENTION

This invention relates generally to slatwall-type display shelving and, more specifically, to interlocking slatwall-type panels and method therefor.

BACKGROUND OF INVENTION

Retail stores often use a slatwall-type display system. Generally, slatwall is manufactured in four by eight foot sheets of laminated particle board. Grooves are cut into each sheet every three inches on center. The grooves are dimensioned to receive a mating end of a variety of display fixtures. The items that are exhibited for sale are then positioned on the display fixtures. Slatwall is commonly seen lining the walls of shoe stores, with shoes mounted for display on small plastic shelves that are inserted into the slatwall grooves.

There are a number of drawbacks to the existing slatwall-type display systems. First, the standard-sized four foot by eight foot sheets are relatively heavy and bulky, making them costly and difficult to transport and install. Second, because the slatwall comes in sheets of wood, the slatwall sheets leave the user with little flexibility in designing a display system, and customization is difficult. These slatwall sheets also have to be framed out with wood or drywall, a process that can be relatively time-consuming and expensive. Thus, if a user desires to customize a display, it is generally necessary to cut one or more larger slatwall sheets down to a smaller size to accomplish this.

There have been some modest efforts to provide an improved slatwall-type display system, but these efforts do not solve the fundamental problems outlined above. Thus, in U.S. Pat. No. 4,805,783, issued to Mayer, a free-standing slatwall-type advertising panel is disclosed. The panel in Mayer comprises an outer frame assembly, into which a varying number of slatwall components may be inserted. However, the Mayer system does not provide a solution to the shortcomings associated with slatwall-type displays that are intended to be affixed to a wall—as opposed to being placed in a free-standing location. Moreover, the Mayer panel does not afford flexibility of design. In Mayer, the user may increase or decrease the number of panels held by the frame in a vertical direction, but may not affix panels in a horizontal direction.

Therefore, a need existed to provide an improved slatwall-type display system and method. The improved system and method must be capable of being used with existing display attachments and must be capable of being attached to a wall in the same manner as traditional slatwall. The improved system and method must also allow for customizing of design, so that virtually any horizontal or vertical configuration of slatwall members may be created. The improved system and method must also be lightweight, for ease of transport and installation. The improved system and method must also allow for ease of framing or trimming when installed over a wall.

SUMMARY OF THE INVENTION

It is an object of the present invention to provide an improved slatwall-type display system and method.

It is another object of this invention to provide a slatwall-type display system and method that is customizable.

It is a further object of this invention to provide a slatwall-type display system and method that is relatively lightweight.

It is still further an object of this invention to provide a stalwall-type display system that is easy to frame and/or trim.

BRIEF DESCRIPTION OF THE PREFERRED EMBODIMENTS

In accordance with one embodiment of the present invention, a modular display system is disclosed. The modular display system comprises, in combination: at least one module having means for receiving display fixtures; means located proximate a top portion of said module for removably coupling said top portion of said module to at least one of a bottom portion of a second module and a first side trim member; means located proximate a bottom portion of said module for removably coupling said bottom portion of said module to at least one of a top portion of a third module and a second side trim member; means located proximate a first side portion of said module for removably coupling said first side portion of said module to at least one of a side portion of fourth module and a third side trim member; and means located proximate a second side portion of said module for removably coupling said second side portion of said module to at least one of a side portion of a fifth module and a fourth side trim member.

In accordance with another embodiment of the present invention, modular display system is disclosed The modular display system comprises, in combination: at least one four-sided module having means for receiving display fixtures; means located proximate each side of said four-sided module for removably coupling each said side to at least one of a side portion of another module and a side trim member.

In accordance with a further embodiment of the present invention, a method for providing a modular display system is disclosed. The method comprises the steps of: providing at least one module having means for receiving display fixtures; providing means located proximate a top portion of said module for removably coupling said top portion of said module to at least one of a bottom portion of a second module and a first side trim member; providing means located proximate a bottom portion of said module for removably coupling said bottom portion of said module to at least one of a top portion of a third module and a second side trim member; providing means located proximate a first side portion of said module for removably coupling said first side portion of said module to at least one of a side portion of fourth module and a third side trim member; and providing means located proximate a second side portion of said module for removably coupling said second side portion of said module to at least one of a side portion of a fifth module and a fourth side trim member.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 1 is an exploded perspective view of the modular display system of the present invention.

FIG. 2 is a side view of a trim member of the present invention featuring male interlocks.

FIG. 2A is a cross-sectional view of a trim member of the present invention, taken along line 2A—2A of FIG. 2.

FIG. 3 is a side view of a trim member of the present invention featuring female interlocks.

DETAILED DESCRIPTION OF THE PREFERRED EMBODIMENTS

Figure 4:
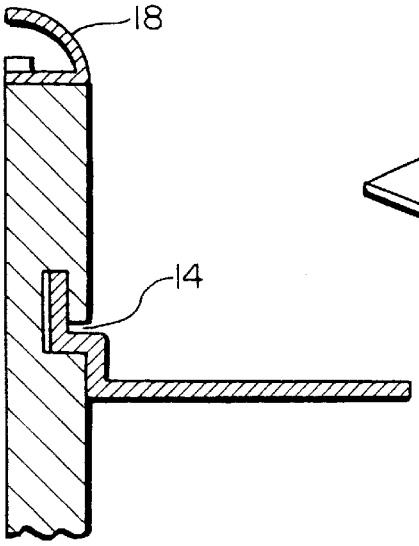
FIG. 4 is a side cross-sectional view of the modular display system of FIG. 1.
Figure 5:
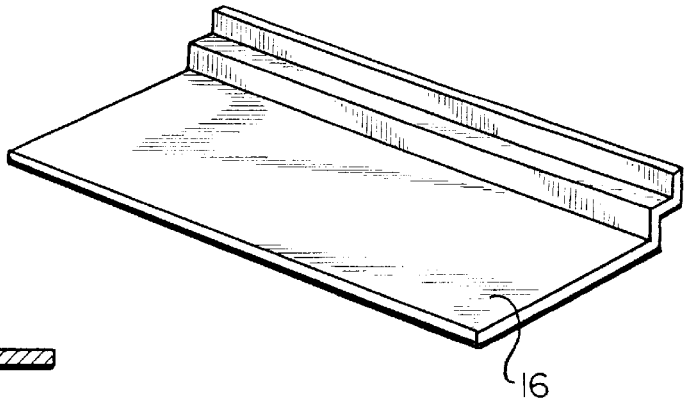
FIG. 5 is a perspective view of a display fixture insertable into the modular display system of the present invention.
Figure 6:
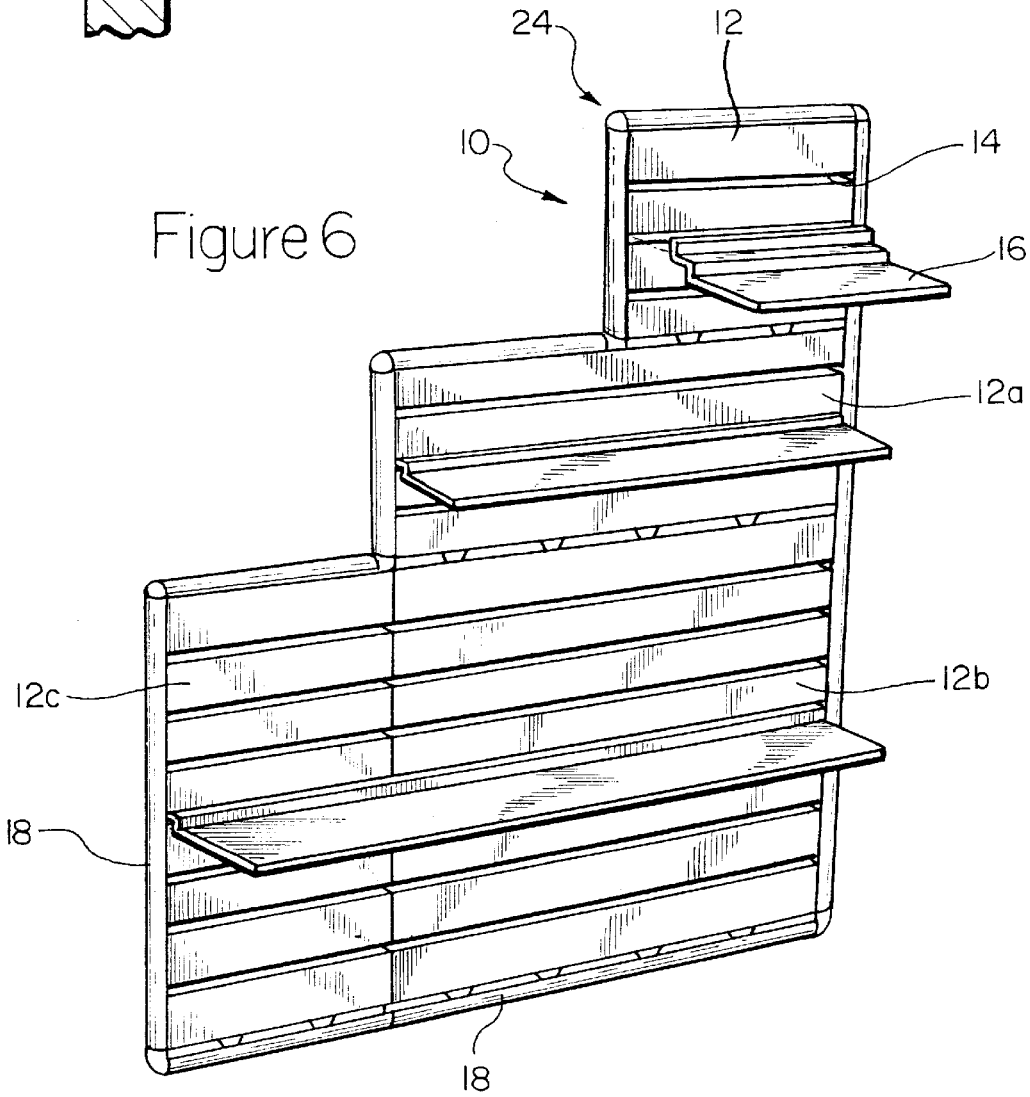
FIG. 6 is a perspective view of an assembled wall display of the present invention.

Referring to the embodiment of FIGS. 1 and 6, reference number 10 refers generally to one embodiment of the modular display system of the present invention. The display system 10 comprises a panel 12, into which the desired number of grooves 14 are cut. (Referring to FIG. 6, three additional embodiments 12*a*, 12*b*, and 12*c* of the panel 12 are shown.) Generally, though not necessarily, the grooves 14 are located three inches apart, although that dimension can be varied as desired. Referring briefly to FIGS. 4 and 5, the grooves 14 are generally though not necessarily L-shaped, and are dimensioned to receive a mating display fixture 16.

As shown in FIGS. 1 and 6, the basic panel—as embodied in panel 12*a*, 12*b*, and 12*c*—can assume an almost limitless number of dimensions, and can have any desired number of grooves 14.

Referring now to FIG. 1, each of the four sides of the panel 12 features connecting means for connecting one panel 12 to one or more additional panels 12 (or panels 12*a*, 12*b*, or 12*c*), and/or to connect one or more sides of the panel 12 to a side trim member 18. The connecting means may comprise male interlocks 20, or female interlocks 22 (not shown). Referring to FIGS. 1, 2, 2A, and 3, the side trim members 18 feature complimentary male interlocks 20 or female interlocks 22. Preferably, the side trim members 18 are bullnose-shaped. In the preferred embodiment, each side of the panel 12 has either two male interlocks 20 or two female interlocks 22, and each of such interlocks 20 and 22 is quadrilateral in shape, although other shapes may be used without departing from the spirit or scope of this invention. The interlocks 20 and 22 are intended to permit the relatively easy attachment and release of adjoining panels and/or panels and trim members, for purposes of facilitating the construction of a display system 10 and as well as its subsequent disassembly or modification.

Referring specifically to FIG. 1, corner trim members 24 may be placed at the intersection of abutting side trim members 18. The corner trim members 24 feature arms 26, which may insert into the ends of the side trim members 18.

FIG. 6 shows an assembled display system 10. As shown in FIG. 6, a variety of different sized panels 12, 12*a*, 12*b*, and 12*c* are interlocked. This interlocking is accomplished with the male and female interlocks 20 and 22. Attached to each of the exposed sides of the panels 12, 12*a*, 12*b*, and 12*c*, are side trim members 18 which are interlocked in the same manner as the panels 12, 12*a*, 12*b*, and 12*c*. Corner trim members 24 join the perpendicular trim members 18. Of course, FIG. 6 shows only one of an infinite number of possible arrangements of the display system 10 of the present invention. Other combinations of panels 12, 12*a*, 12*b*, 12*c*, and side trim members 18 and corner trim members 24 are possible. Moreover, the dimensions of each of these component parts of the display system 10 can be varied as desired.

Preferably, each of the component parts of the display system 10 are made of injection molded polystyrene or polypropylene. This material makes the display system 10 and its component parts lighter and thus easier to install and ship than the prior art slatwall systems, and provides manufacturing efficiency and flexibility. However, it is possible to manufacture the display system 10 from other plastic materials without departing from the spirit or scope of this invention. Certain or all of the components of the display system 10 may also be manufactured from any non-plastic material, including wood or particle board, while still preserving many of the advantages of this invention—including flexibility of design and installation.

While the invention has been particularly shown and described with reference to preferred embodiments thereof, it will be understood by those skilled in the art that the foregoing and other changes in form and details may be made therein without departing from the spirit and scope of the invention.

I claim:

1. A modular display system comprising, in combination:

at least one module having means for receiving display fixtures, said module including:

means located proximate a top portion of said module for removably coupling said top portion of said module directly to alternatively either at least one of a bottom portion of a second module or a first side trim member;

means located proximate a bottom portion of said module for removably coupling said bottom portion of said module directly to alternatively either at least one of a top portion of a third module or a second side trim member;

means located proximate a first side portion of said module for removably coupling said first side portion of said module directly to alternatively either at least one of a side portion of a fourth module or a third side trim member;

means located proximate a second side portion of said module for removably coupling said second side portion of said module directly to alternatively either at least one of a top portion of a fifth module or a fourth side trim member.

2. A modular display system in accordance with claim 1 further comprising a plurality of side trim members.

3. A modular display system in accordance with claim 2 further comprising a plurality of corner trim members located in end portions of abutting side trim members.

4. A modular display system in accordance with claim 1 wherein said module is comprised of plastic.

5. A modular display system in accordance with claim 1 wherein said module is comprised of injection molded polystyrene.

6. A modular display system in accordance with claim 1 wherein said module is comprised of injection molded polypolypropylene.

7. A modular display system in accordance with claim 1 wherein each side trim member is bullnose-shaped.

8. A modular display system comprising, in combination:

at least one four-sided module having means for receiving display fixtures;

means located proximate each side of said four-sided module for removably coupling each said side directly to alternatively either at least one of a side portion of another module or a side trim member.

9. A modular display system in accordance with claim 8 wherein said means comprise at least one of a quadrilateral shaped member extending outward from each side of said module and a corresponding quadrilateral shaped opening extending into said each side of said module.

10. A method for providing a modular display system comprising the steps of:

providing at least one module having means for receiving display fixtures and;

means located proximate a top portion of said module for removably coupling said top portion of said module directly to alternatively either at least one of a bottom portion of a second module or a first side trim member;

means located proximate a bottom portion of said module for removably coupling said bottom portion of said module directly to alternatively either at least one of a top portion of a third module or a second side trim member;

providing means located proximate a first side portion of said module for removably coupling said first side portion of said module directly to alternatively either at least one of a side portion of a fourth module or a third side trim member; and providing means located proximate a second side portion of said module for removably coupling said second side portion of said module directly to alternatively either at least one of a side portion of a fifth module or a fourth side trim member.

11. The method of claim 10 further comprising the step of providing a plurality of side trim members.

12. The method of claim 11 further comprising the step of providing a plurality of corner trim members located in end portions of abutting side trim members.

13. The method of claim 10 further comprising the step of fabricating said modular display system from plastic.

14. The method of claim 10 further comprising the step of fabricating said modular display system using injection molded polystyrene.

15. The method of claim 10 further comprising the step of fabricating said modular display system using injection molded polypropylene.

16. The method of claim 10 wherein each side trim member is bullnose-shaped.

17. A method for constructing a modular display system comprising a plurality of multi-sided modules and a plurality of side trim members, each module having means for receiving display fixtures and including on each side removable coupling means for coupling the side directly to alternatively either one of the sides of another one of the modules or one of the trim members, the method comprising the steps of:

(a) removably coupling each of some of the sides of the modules directly to a respective side of one of the other modules; and (b) removably coupling each of the other sides of the modules directly to a respective trim member.

18. The method in accordance with claim 17 wherein each of the removable coupling means comprises an interlock.

19. The method in accordance with claim 17 wherein each of said modules is comprised of injection molded polystyrene.

20. The method in accordance with claim 17 wherein each of said modules is comprised of injection molded polypropylene.

21. A modular display system comprising a plurality of four-sided modules and a plurality of side trim members, each module having means for receiving display fixtures and including means located proximate each side of said module for removably coupling each said module directly to alternatively either at least one of a side of an other of said modules or one of said side trim members.

22. The modular display system in accordance with claim 21 wherein each of the removable coupling means comprises an interlock.

* * * * *